US005936334A

United States Patent [19]

Gärtner et al.

[11] Patent Number: 5,936,334

[45] Date of Patent: Aug. 10, 1999

[54] IMPREGNATED CATHODE WITH COMPOSITE TOP COAT

[75] Inventors: Georg Gärtner, Aachen, Germany; Jan Hasker, Eindhoven, Netherlands

[73] Assignee: U.S. Phillips Corporation, New York, N.Y.

[21] Appl. No.: 08/332,620

[22] Filed: Oct. 31, 1994

Related U.S. Application Data

[63] Continuation of application No. 07/989,625, Dec. 14, 1992, abandoned.

[30] Foreign Application Priority Data

Dec. 21, 1991 [DE] Germany ..... 41 42 535

[51] Int. Cl.[6] ..... H01J 1/14

[52] U.S. Cl. ..... 313/346; 313/337

[58] Field of Search ..... 313/630, 633, 313/337, 346 R, 352; 445/50, 51

[56] References Cited

U.S. PATENT DOCUMENTS

| | | | |
|---|---|---|---|
| 4,101,800 | 7/1978 | Thomas et al. | 313/346 R |
| 4,594,220 | 6/1986 | Hasker et al. | 313/346 R |
| 4,783,613 | 11/1988 | Yamamoto et al. | 313/346 R |
| 4,855,637 | 8/1989 | Watanabe et al. | 313/346 |
| 4,980,603 | 12/1990 | Kimura et al. | 313/346 R |
| 5,006,753 | 4/1991 | Hasker et al. | 313/346 R |
| 5,318,468 | 6/1994 | Lotthammer et al. | 445/50 |

*Primary Examiner*—Vip Patel

*Attorney, Agent, or Firm*—John C. Fox

[57] ABSTRACT

A cathode having a matrix body (1) impregnated with an alkaline earth compound, whose surface is provided with a top coat (2, 3, 4) comprising a high melting point metal, such as particularly tungsten, and scandium. A high emission at a low operating temperature and simultaneously a rapid recuperation after ion bombardment as well as a long lifetime are achieved in that the top coat comprises at least two layers of different composition, with a purely metallic layer (5, 6, 7) being provided on the impregnated matrix body (1), which layer comprises scandium and a high melting point metal such as particularly tungsten and/or rhenium, and in that a metallic layer of a high melting point metal such as particularly tungsten is provided as a sealing layer.

9 Claims, 1 Drawing Sheet

IMPREGNATED CATHODE WITH COMPOSITE TOP COAT

This is a continuation of application Ser. No. 07/989,625, filed Dec. 14, 1992 now abandoned.

BACKGROUND OF THE INVENTION

The invention relates to a cathode having a matrix body impregnated with an alkaline earth compound, whose surface is provided with a top coat comprising a high melting point metal, such as particularly tungsten, and scandium.

A cathode of this type is known from U.S. Pat. No. 4,855,637. This patent proposes a top coat provided by sputtering, which consists of single layers of different density comprising tungsten and scandium.

Heated cathodes with top coats comprising scandium have a high emission at relatively low temperatures, for example 100 A/cm$^2$ at 950° C. When used in vacuum tubes having a high electron emission current load of the cathode, particularly for projection television, HDTV and high-resolution monitors, these cathodes are very suitable due to their high emission. In this respect it is important that the cathodes have a satisfactory resistance or regeneration capability after an ion bombardment which occurs when forming the tube or under poor vacuum conditions. The ion bombardment causes the evaporation of the barium oxygen surface complex on tungsten which is responsible for the high emission of such an alkaline earth dispenser cathode. A satisfactory recuperation after ion bombardment requires a rapid dispensation of the components involved, particularly also of scandium.

OBJECTS AND SUMMARY OF THE INVENTION

It is an object of the invention to realize a cathode of the type described in the opening paragraph in such a way that a high emission at a low operating temperature and simultaneously a rapid recuperation after ion bombardment as well as a long lifetime are achieved.

This object is achieved in that the top coat comprises at least two layers of different composition, with a purely metallic layer being provided on the impregnated matrix body, which layer comprises scandium and a high melting point metal such as particularly tungsten and/or rhenium, and in that a metallic layer of a high melting point metal such as particularly tungsten is provided as a sealing layer.

It has been found that a very rapid dispensing of scandium at the area of the tungsten surface of the top coat is achieved if purely metallic scandium instead of oxidic scandium is present in the top coat underneath a tungsten layer. The scandium may be present in an intermetallic compound, for example $Ni_2Sc$ or particularly $Re_2Sc$ or $Re_{24}Sc_5$. The Sc diffusion at the tungsten surface is realised much more rapidly than an Sc oxide diffusion. A long lifetime as well as a uniform emission behaviour across the emissive surface is achieved with the sealing layer of metallic tungsten.

In a further advantageous embodiment the first purely metallic layer comprises tungsten and scandium. The scandium which is present in a purely metallic form segregates very rapidly on the tungsten surface. A too high evaporation of scandium which may then occur can be prevented in that at least one layer comprising scandium oxide is provided between the first metallic layer comprising scandium and tungsten and the sealing tungsten layer.

Particularly in the case of thicker top coats the dispensing of alkaline earth oxide through the top coat to the tungsten surface can be improved by providing the top coat with perforations extending as far as the matrix body.

It was found that cathodes according to the invention can be manufactured very advantageously when purely metallic layers of scandium and/or rhenium are manufactured by means of a particular plasma-activated CVD method, preferably by means of a plasma generated by DC glow discharge and that subsequently a metallic tungsten layer is provided as the last layer by means of a CVD method.

In contrast to a powder metallurgic method, such a method yields much finer structures and hence an improved Sc dispensing to the tungsten surface. Also as compared with, for example, a top coat manufactured by sputtering, a more uniform layer structure which can be structured in a finer manner is obtained when using the method according to the invention, particularly in a plasma-activated CVD method (PCVD). Moreover, metallic scandium (in succession with W, Re) can be realised in a simpler manner than an oxidic scandium by means of a CVD method.

It is possible to form intermetallic scandium compounds directly in the top coat by a simultaneous supply of suitable gases which comprise scandium in the form of organic compounds and a further metal such as particularly rhenium.

In a suitable modification of the method the constituents of the top coat are each provided in the form of separate and possibly alternating layers. From a technical point of view, a desired structure can then be realised in a very simple manner. The envisaged intermetallic compound can then be formed by suitable thermal post-treatment.

If scandium oxide layers are incorporated in the top coat, they can be formed in a simple manner by oxidizing at least one of the scandate layers by means of an oxygen-containing plasma before the next layer is provided.

BRIEF DESCRIPTION OF THE DRAWINGS

These and other aspects of the invention will be apparent from and the embodiments described hereinafter as elucidated with reference to the drawing in which.

DESCRIPTION OF THE PREFERRED EMBODIMENTS

Figure 1:
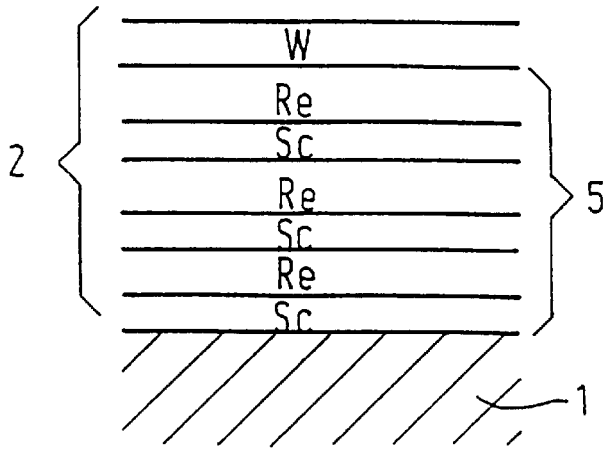
FIG. 1 is a cross-sectional view of a cathode element according to the invention, comprising scandium layers alternating with rhenium layers before a thermal treatment.

In the Figures the reference numeral 1 denotes cathode pills which comprise a tungsten matrix impregnated with $4BaO.CaO.Al_2O_3$ or $5BaO.3CaO.2Al_2O_3$. The cathode pills 1 are provided with scandium-containing top coats 2, 3 and 4 of approximately 20 $\mu$m by means of a plasma-activated CVD method (PCVD). According to the invention, the top coats comprise a first purely metallic layer 5, 6, 7, respectively and a sealing tungsten layer.

In accordance with FIG. 1, Sc layers and Re layers and a sealing W layer are alternately provided on the cathode pill 1 by means of PCVD.

Figure 2:
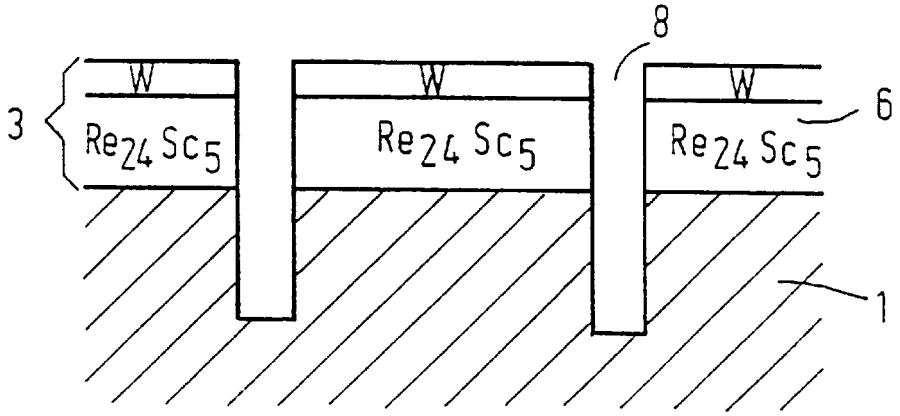
FIG. 2 is a cross-sectional view of a cathode element according to the invention, comprising a layer of an intermetallic scandium-rhenium compound.

By means of a suitable thermal post-treatment it can be achieved that a layer comprising an intermetallic compound $Re_{24}Sc_5$ which is advantageous for the dispensing of Sc is formed from the separate metallic Sc and Re single layers, as is shown in FIG. 2.

The layer of the intermetallic compound $Re_{24}Sc_5$ of FIG. 2 may also be obtained in advance by simultaneous separation from the gas phase.

Figure 3:
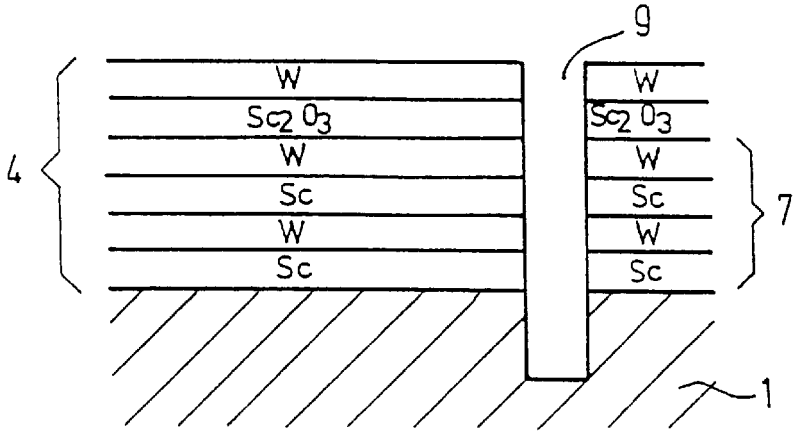
FIG. 3 is a cross-sectional view of a cathode element according to the invention, comprising metallic scandium layers alternating with tungsten layers.

In FIG. 3 the top coat 4 comprises Sc layers alternating with W layers. An $Sc_2O_3$ layer is provided underneath the sealing W layer. All single layers of the top coat 4 are provided by means of PCVD.

In FIGS. 2 and 3 the top coats 3 and 4 are provided with perforations 8 and 9 having a width of approximately 1 to 2 $\mu$m and being spaced apart by approximately 20 $\mu$m and punched by means of an NdYAG or excimer laser through top coats polished in advance.

The PCVD deposition can be carried out by means of suitable known devices. For example, a multitude of cathode pills 1 may be arranged on the inner wall of a supporting cylinder and then coated in a device as described in EP-B-0204356.

Metallic Sc layers can be deposited from an Ar inert gas charged with $Sc(C_5H_7O_2)_3$ or with $Sc(C_5H_4F_3O_2)_3$ or with $Sc(C_5HF_6O_2)_3$, $H_2$ being supplied to the PCVD reactor in a 10 to 20-fold as compared with the Sc compound. After deposition of the Sc layer, an $Ar/H_2$ plasma post-treatment is performed.

Metallic Re layers according to FIG. 1 may be deposited from $ReF_6/H_2$.

A simultaneous deposition for the direct formation of an intermetallic Sc/Re layer may advantageously be performed from an $Sc(C_5H_7O_2)_3/ReF_6/H_2$ gas mixture with $Ar/H_2$ intermittent treatments. Another Sc β diketonate or an Sc halide may be used as a scandium-containing starting compound.

The $Sc_2O_3$ layer according to FIG. 3 may be formed from a metallic Sc layer by subsequently treating it with a plasma-activated oxygen-containing gas mixture, particularly $Ar/O_2$.

It is of course possible to introduce an alkaline earth oxide doping by means of PCVD in the top coats (2, 3, 4) in which, for example, simultaneously with $Sc/ScO_x$ also BaO and/or CaO are deposited from suitable gaseous starting compounds.

We claim:

1. A cathode having a matrix body impregnated with an alkaline earth compound, a top coat on the surface of the body, the top coat comprising a high melting point metal, characterized in that the coat comprises at least first and second layers, each of different chemical composition, the first layer, in contact with the body, consisting essentially of scandium and a high melting point metal, the second layer being a metallic sealing layer consisting essentially of a high melting point metal.

2. A cathode as claimed in claim 1, characterized in that the first layer consists essentially of an intermetallic compound of scandium and rhenium or nickel.

3. A cathode as claimed in claim 2, characterized in that the top coat has perforations extending as far as the matrix body.

4. A cathode as claimed in claim 1, characterized in that the first layer consisting essentially of and scandium.

5. A cathode as claimed in claim 2, characterized in that the top coat has perforations extending as far as the matrix body.

6. A cathode as claimed in claim 1, characterized in that the top coat has perforations extending as far as the matrix body.

7. A cathode having a matrix body impregnated with an alkaline earth compound, a top coat on a surface of the body, the top coat comprising a high melting point metal, characterized in that the top coat comprises at least first, second and third layers, each of different chemical compositions, the first layer in contact with the body, consisting of essentially of separate alternating sublayers of tungsten and of scandium, the second layer being a metallic sealing layer and consisting of a high melting point metal and the third layer, consisting essentially of scandium oxide, positioned between said first and second layers.

8. A cathode as claimed in claim 7, characterized in that the top coat has perforations extending as far as the matrix body.

9. A cathode as claimed in claim 8, characterized in that the second layer consists essentially of tungsten.

* * * * *